US008813435B2

(12) United States Patent
Kennedy et al.

(10) Patent No.: US 8,813,435 B2
(45) Date of Patent: Aug. 26, 2014

(54) METHOD OF FORMING A TERMITE BARRIER

(75) Inventors: Anthony William Kennedy, Queensland (AU); John Charles Hitchen, Queensland (AU)

(73) Assignee: Magisurf Pty Ltd (AU)

( * ) Notice: Subject to any disclaimer, the term of this patent is extended or adjusted under 35 U.S.C. 154(b) by 504 days.

(21) Appl. No.: 12/066,296

(22) PCT Filed: Sep. 12, 2006

(86) PCT No.: PCT/AU2006/001340
§ 371 (c)(1),
(2), (4) Date: Mar. 10, 2008

(87) PCT Pub. No.: WO2007/030875
PCT Pub. Date: Mar. 22, 2007

(65) Prior Publication Data

US 2008/0295446 A1 Dec. 4, 2008

(30) Foreign Application Priority Data

Sep. 12, 2005 (AU) ..... 2005905011

(51) Int. Cl.
*E04B 1/72* (2006.01)
*E04H 9/16* (2006.01)
*A01M 1/24* (2006.01)
*A01M 1/20* (2006.01)

(52) U.S. Cl.
USPC ..... 52/101; 43/124; 43/132.1

(58) Field of Classification Search
USPC ..... 43/134, 132.1; 52/101
See application file for complete search history.

(56) References Cited

U.S. PATENT DOCUMENTS

| | | | | | |
|---|---|---|---|---|---|
| 2,017,106 | A * | 10/1935 | Sandell | 428/175 |
| 4,823,520 | A * | 4/1989 | Ebeling et al. | 52/101 |
| 5,904,007 | A * | 5/1999 | Trapnell | 52/101 |
| 6,094,857 | A * | 8/2000 | Kennedy et al. | 43/132.1 |
| 6,205,718 | B1 * | 3/2001 | Murphy et al. | 52/101 |
| 7,748,161 | B1 * | 7/2010 | Jordan, Jr. | 43/132.1 |
| 2003/0172849 | A1 * | 9/2003 | Collier | 106/805 |
| 2004/0163332 | A1 * | 8/2004 | Raymond | 52/101 |
| 2005/0217537 | A1 * | 10/2005 | Knipe | 106/493 |
| 2006/0101708 | A1 * | 5/2006 | Cox | 43/132.1 |
| 2006/0201053 | A1 * | 9/2006 | Voris et al. | 43/124 |
| 2009/0014112 | A1 * | 1/2009 | Evans et al. | 156/71 |
| 2010/0043307 | A1 * | 2/2010 | Koester | 52/58 |

FOREIGN PATENT DOCUMENTS

| | | | |
|---|---|---|---|
| AU | 199876163 | A1 | 2/1999 |
| AU | 08 12 99 64430 | * | 12/1999 |
| AU | 200214718 | A1 | 8/2002 |
| AU | 2002300932 | B1 * | 2/2003 |
| AU | 2002308911 | B2 | 3/2003 |
| AU | 2002308911 | B2 * | 3/2005 |
| AU | 2005200756 | A1 | 3/2005 |

* cited by examiner

*Primary Examiner* — Ryan Kwiecinski
(74) *Attorney, Agent, or Firm* — McCormick, Paulding & Huber LLP

(57) ABSTRACT

A method of inhibiting the migration of termites into a structure is provided including the steps of forming a band across exposed faces of external masonry walls of the structure wherein the band is disposed above ground level and includes, at least in part, a settable composition wherein in a set condition the settable composition is sealably engaged with a physical termite barrier, said physical termite barrier forming at least part of a termite barrier extending between a concrete slab of the structure and a mortar course in the external masonry walls.

16 Claims, 5 Drawing Sheets

METHOD OF FORMING A TERMITE BARRIER

FIELD OF THE INVENTION

The present invention relates to a method and means for preventing or minimising termite attack or infestation which is particularly but not exclusively suited to applications in buildings.

BACKGROUND OF THE INVENTION

Termites that damage buildings and other structures are most commonly subterranean. Their attack/infestation originates from the nest (colonies) located either underground or in the base of trees, with tunnels (foraging galleries) radiating from the nest through the soil to food sources.

At all times termites require moisture but must conceal themselves from direct sunlight. Thus for travel across exposed faces of walls, for example, they build mud-like shelters (tunnels) "plasters" on the exposed faces in which they can travel, concealed from sunlight to their food source. The area for subterranean migration may comprise a crack, fissure, joint, opening, perpend, mortar joint, (and areas underneath termite barriers when installed across a masonry brick/block course to an external face of the building) or the like in an outer wall, footing or slab cavity.

Due to changes in government regulations in Australia and elsewhere, past methods of preventing termite attack or entry in buildings which have involved the use of many termiticides under the slab and around the outside periphery of a building is now no longer possible to employ because of the potentially detrimental effects of the residual termiticides. Whilst new termiticides or termite repellent chemicals have been introduced to overcome this problem, such chemicals prove considerably more expensive to use. As a result, a number of different methods have been proposed or are now used with the aim of combating termite infestation or migration.

An approach adopted in buildings having concrete slab is to form a physical termite barrier between the slab and the external masonry walls. The barrier is typically attached to the slab and across the wall cavity to an external wall and positioned at a mortar course above ground level.

One such method involves the use of a product known as TERMIMESH which comprises a mesh of stainless steel which has pores of sufficiently small size to prevent the passage of termites therethrough. The outer edge of the mesh is located in a mortar course of an external wall. Typically, a damp proof course may be applied on top of the mesh and then mortar and a subsequent masonry course are laid on top of the mortar.

In our earlier application, we provided a method of preventing or minimising migration of termites by applying a settable or curable termite or insect resistant barrier mixture which when applied cures to form a continuous flexible penetration resistant barrier which adheres to and extends between an above ground exposed portion of the outer wall skin and the slab.

With these techniques, the physical barriers generally terminate at or near the edge of a mortar course on the external masonry face. We have found that termites can breach such barriers through imperfections in the mortar or the masonry bricks/blocks and circumvent the physical barrier with a short "plaster" that simply extends across the edge of the barrier in a manner that makes the detection of such plasters difficult.

The present invention aims to overcome or alleviate at least one of the above disadvantages by providing improved methods of and means for preventing or minimising the passage or migration of termites or other insects into a building. Other objects and advantages of the invention will become apparent from the following description.

SUMMARY OF THE INVENTION

In accordance with a first aspect of the present invention there is provided a method of inhibiting the migration of termites into a structure comprising forming a band across exposed faces of external masonry walls of the structure wherein said band is disposed above ground level and includes, at least in part, a settable composition wherein in a set condition said settable composition is sealably engaged with a physical termite barrier, said physical termite barrier forming at least part of a termite barrier extending between a concrete slab of the structure and a mortar course in the external masonry walls.

The method of the first aspect of the present invention is applicable to a wide variety of structures having external masonry walls and a concrete slab. There are a number of structures which combine a concrete slab with external masonry walls. One such structure has a footing on which both a subsequently formed concrete slab as well as a masonry wall are formed. Often in structures having a separate footing, there is a cavity formed between the concrete slab and the external wall. Of course, the first aspect of the present invention is applicable to such structures whether or not a cavity is formed between the concrete slab and the external wall.

Other structures that incorporate a concrete slab and external masonry walls have the footing for the external masonry walls formed integrally with the slab concrete. Such structures are often described as "monolithic slabs".

Physical termite barriers suitable for use with the first aspect of the present invention including a wide variety of barriers such as, but not limited to, termite resistant mesh such as stainless steel mesh, a layer of termite resistant material such as a termite resistant plastic or any other preformed or formed in situ physical barriers that can prevent termite penetration and be located in a mortar course in the external masonry wall. For example, a stainless steel mesh may be adhered to, or embedded in, the concrete slab or may be indirectly attached to the concrete slab, such as by being embedded in a bed of termite resistant parge that abuts the concrete slab and extends into a mortar course in an external masonry wall.

The physical barrier extends into a mortar course in the external masonry wall. The mortar course into which the physical barrier extends is above ground level and is preferably at or above any weep holes in the masonry wall.

The band of the present invention includes, at least in part a settable termite resistant composition. The band may be formed entirely from a settable composition or may have a pre-formed outer surface which is sealably engaged with the physical termite barrier by a settable composition disposed between the physical termite barrier and the pre-formed surface. A pre-formed surface may be used to provide ready visibility of any "plasters" that termites may use to bridge the band. The band may also provide a visible indication to a potential purchaser of a structure that the structure has been suitably treated to prevent the colonisation of termites.

The settable composition sealably engages the physical termite barrier, typically within a mortar course of an external masonry wall. In a preferred method of this aspect of the present invention, the physical termite barrier is positioned between two courses of masonry bricks/blocks with mortar extending part way across the top of the masonry bricks/blocks so as to leave the external edge of the physical termite barrier exposed. Advantageously, this allows for ready sealing engagement of the physical barrier by the settable composition.

The settable composition may be selected from a range of different products or a combination of products. It may be in the form of a paste, gel, liquid or a matrix mix. As an example, the settable composition may form a uni cellular membrane, that is a membrane in which a cellular chemical agent such as a termiticide is encapsulated. The settable composition may include polymer binders, mineral extenders, biocides, fingicides, mould inhibitors, acrylic resins, acrylic emulsions, powered acrylic polymers, and/or moisture control, reinforcement such as fibrous matting, waterproofing or water-repellent agents and plasticising agents. The settable composition may additional include a chemical or chemicals which comprise a termiticide, an insecticide or a termite deterrent. Suitable termite resisting components may be borax, boron or boric acid.

The settable composition may be applied in any suitable manner, for example by spraying, painting, trowelling, brushing, splattering or extrusion such as through a cartridge tube or the like. In a preferred form of the present invention, the settable composition may be a silicone, or an acrylic based composition such as may be used as a gap filler or corking agent. It will be appreciated that by settable, we mean a composition that may be applied in liquid form and which, upon setting, forms a solid or semi-solid member. Examples of settable compositions include compositions that may be applied "hot" and allowed to "set" upon cooling of the composition in situ. Also composition which are chemically cured in situ will be considered settable compositions.

The band is sufficiently dimensioned such that any bridging of the band by termite plasters may be readily visibly detected. Preferably the band is at least 20 mm in width; is preferably at least 50 mm in width, and even more preferably at least 75 mm in width to form a clearly visible inspection zone.

The termite resistant sealant which we described below can be used as the curable settable composition.

One of the potential places through which termites can access a building is through mortar joints in a masonry wall. It will be understood mortar joints include mortar courses and perpends. Mortar is susceptible to termite penetration, either in contiguous form or such as through cracks that can permit entry by termites. We have found that by sealing mortar joints that have a physical termite barrier embedded therein we are able to inhibit the migration of termites into a structure by converting the mortar area into a physical termite barrier.

According to a second aspect of the present invention, there is provided a method of inhibiting the migration of termites into a structure wherein the structure comprises an external masonry wall, the method including sealing with a termite resistant sealant at least one course of mortar wherein said course of mortar includes a physical termite barrier extending into the mortar course whereby a band of sealant is formed across exposed faces of external masonry walls of the structure.

In a preferred method, the sealant is applied to the external masonry face or render to form a termite resistant barrier and inspection zone, from where a physical termite barrier protrudes from a mortar course. The sealant may extend down to the footing.

The termite resistant sealant includes waterproofing and/or water repelling agents as well as termiticides or termite deterrents along with other preservatives and fillers. A silicone or other based sealant composition that incorporates a termiticide or a termite deterrent. In one preferred form, the sealant is a clear sealant. It will be apparent to those skilled in the art that a variety of other termite resistant sealants in this aspect of the present invention.

The termite resistant sealant may be formed by applying a band of sealant over the exposed faces of a mortar course of an external masonry wall of a structure. The band of sealant may be applied, such as by painting, spraying, brushing or rolling, over the exposed faces to cover the said course of mortar and preferably sealably engages with the physical termite barrier.

The band for use in this second aspect of the present invention at least extends across one mortar course on the exposed faces of the external masonry walls of the structure, preferably across a distance of 75 mm.

In a preferred embodiment of this aspect of the present invention the termite resistant sealant may be incorporated into the mortar blend such when set the mortar integrally includes the termite resistant sealant. Alternatively, the termite resistant sealant may be incorporated into a cement render applied to the external masonry walls.

The termite resistant sealant may extend into the cavity between the external masonry wall and the concrete slab. The termite resistant sealant may extend through the mortar of the external masonry wall, optionally down the inside of the external walls, and engage with a physical termite barrier disposed within the wall cavity. Alternatively, the termite resistant sealant may engage within the wall cavity with other types of termite resistant materials.

The termite resistant composition in the friable particulate material may be regenerated from time to time by dousing the friable particulate material, either through inspection/regeneration ports provided in the external wall or through a reticulation system that may be installed at the time of construction or retro fitted. In one embodiment, the friable particulate material may be regenerated by drilling holes through mortar joints through which the termite resistant composition may be injected or sprayed. Conveniently, the holes may be resealed with a termite resistant sealant.

The termite resistant sealant may also be used over a rendered wall. In a preferred form, the termite resistant sealant may be applied to an external wall extending at least across the mortar joint that incorporates at least a physical termite barrier. Thereafter, the wall may be rendered and on which render, adjacent the initial termite resistant sealant, a further band of termite resistant sealant may be applied. In this way, a band of termite resistant sealant is provided in a visible location over which termites would need to establish plasters through which to migrate. The position of the band providing a visible indication of the presence of such plasters.

In many applications, the physical termite barrier extends from the slab, across the cavity, or footing on which the concrete slab and external walls are supported. Often, the joint between the footing and the concrete slab or the external walls may be breached by termites, thereby accessing the wall cavity and potentially the timberwork in the structure. Whilst extending a physical barrier between the slab and the external wall prevents direct access to the timberwork of the building, as described above the termites can bridge the barrier by forming a plaster around the barrier or passing through any tear or other breach or across or over the barrier, such as the barrier not being sealed to the external block/brick course to the perimeter or mortar course or slab connection. We have found that by covering the base of the cavity between the slab and the external masonry walls with a friable particulate material, which incorporates a termite resistant composition, the base of the cavity can be kept free of termites that gain access by penetrating the mortar even when movement between the footing and either the concrete slab or the external walls results in a crack or fissure that could provide access for termites.

According to a third aspect of the present invention, there is provided a method of inhibiting the migration of termites into a structure wherein the structure comprises a concrete slab, a footing and an external masonry wall, the concrete slab and the external masonry wall being supported on the footing and being spaced apart whereby a wall cavity is formed therebetween, the method including covering the base of the cavity with a friable particulate material, which friable particulate material incorporates a termite resistant composition.

It will be understood that the footing may be a separately formed footing or may be integrally formed with the concrete slab in the form of a "monolithic slab".

The friable particulate material for use with the third aspect of the present invention may be formed from any convenient granular material. We have found that one convenient granular material for use in this aspect of the present invention is sand or foam beads. We appreciate that granular material of larger size may also be used. The granular material may be inert or may have termite resistant properties. The particulate material is friable, that is, the particulate material is capable of flowing to at least a limited degree. Thus, any relative movement between the footing and either the concrete slab joint line or an external masonry wall will result in the particulate material flowing to at least cover any gaps that may be created.

The friable particulate material incorporates a termite resistant composition. The termite resistant composition may be an inherent property of the friable particulate material or may be applied to the particulate material either during its manufacture and thus be incorporated within the particulate material. Alternatively, the termite resistant composition may be applied as a coating to the individual pieces of particulate material or to the mass of particulate material. The termite resistant compositions may be any suitable termite resistant composition and in a preferred form of this aspect of the present invention, the termite resistant composition may be the termite resistant sealant described above. Liquid sealant may be applied to the particulate material to coat the particulates. The sealant may also be absorbed into porous particles, in the same manner as it can be absorbed into mortar. It is also preferred that the sealant is applied to the wall cavity over the courses of bricks or blocks and extending onto the external face of the external masonry wall to provide an inspection band that may extend down to the footing.

According to a fourth aspect of the present invention, there is provided a method of inhibiting the migration of termites into a structure wherein the structure comprises a concrete slab, a footing and an external masonry wall, the concrete slab and the external masonry wall being supported on the footing, the external masonry wall abutting the slab, the method including applying a bead of termite resistant sealant to the joint between the slab and a course of the bricks or blocks of the external masonry wall and further applying a sealant extending from the slab, over the bead of termite resistant sealant and over the course of bricks or blocks and extending onto the external face of the external masonry wall to provide an inspection band. The inspection band may extend down to the footing or slab beam.

It will be understood that the footing may be a separately formed footing or may be integrally formed with the concrete slab in the form of a "monolithic slab".

According to a fifth aspect of the present invention, there is provided a method of inhibiting the migration of termites into a structure wherein the structure comprises monolithic slab supporting an external masonry wall, the method including sealing with a termite resistant sealant from the monolithic slab over the external masonry wall and to cover at least one exposed course of mortar whereby a band of sealant is formed across exposed faces of external masonry walls of the structure.

According to a sixth aspect of the present invention, there is provided a method of inhibiting the migration of termites into a structure wherein the structure comprises a masonry support wherein said method includes applying a sealant extending over or through the masonry support and onto any external faces of the masonry support to provide an inspection band, which inspection band may extend down to the footing or slab.

The masonry supports to which the sixth aspect of the present invention relates may include piers, retaining walls and supporting walls and other masonry elements of a structure.

Figure 1A:
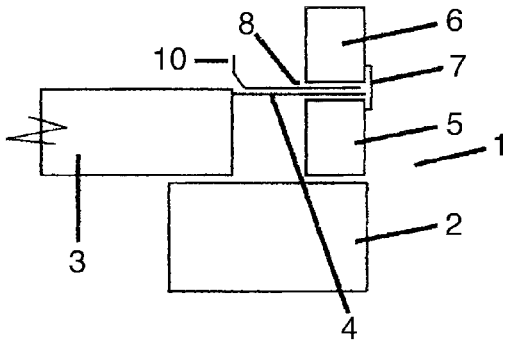
FIG. 1A shows a section of a building structure incorporating a slab and a masonry course supported by a footing.
Figure 1B:
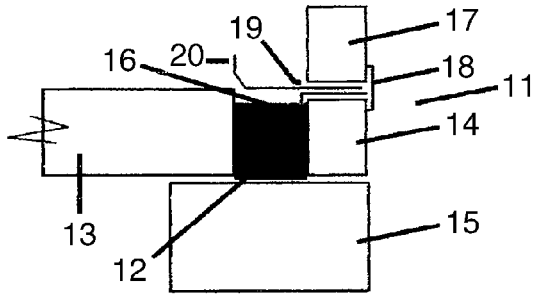
FIG. 1B shows a section of a building structure incorporating a slab and a masonry course supported by a footing incorporating a friable termite resisting composition between the slab and the masonry course.

In order that the various aspects of the invention may be more fully understood and put into practical effect, a number of preferred embodiments will be described with reference to the accompanying drawings, in which:

FIG. 1*a* shows a section 1 of a building structure that is supported by a footing 2. Abutting the footing 2 is a slab 3. A termite barrier 4 extends from the slab 3 and terminates between a masonry course 5 and a masonry course 6. The termite barrier 4 engages a band 7. The band 7 may be a pre-formed band or a band of a sealant material that may be applied to the structure after the termite barrier 4 is fixed in situ between the masonry course 5 and masonry course 6. A mortar course 8 sits on the damp proof course 10 between the masonry courses 5 and 6. FIG. 1*b* shows a section 11 of a building that incorporates a friable termite resisting composition 12 such as graded granite or glass between the slab 13 and the course of masonry course 14 as well as the friable termite resisting composition 12 rests on a footing 15. The friable termite resisting composition 12 includes graded stone or glass particles that include or have been coated with a termite resisting composition. A physical termite barrier 16 extends from between the masonry course 14 and the masonry course 17 into the friable termite resisting material. A band 18 engages the peripheral edge of the termite resisting strip 16 and forms a visible inspection barrier on the outer surface of the structure. A mortar course 19 rests on the damp proof course 20.

FIGS. 1*a* and 1*b* also show a damp proof course 10 and 20 respectively that extends from the slab or internal wall of the structure to the external masonry wall.

Figure 2:
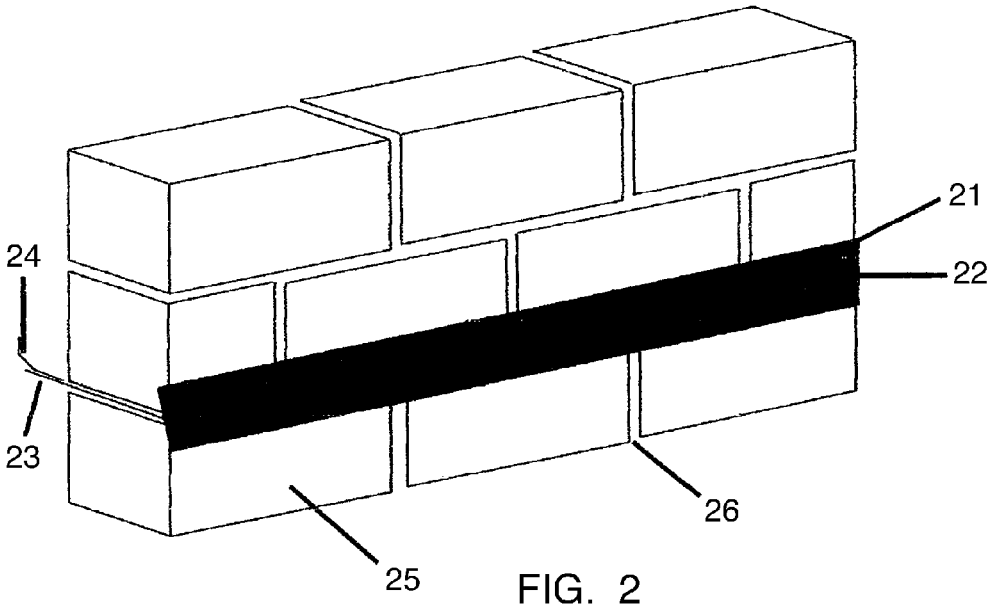
FIG. 2 is an isometric view of an external wall of a structure with a termite resistant band extending across an external surface.

FIG. 2 shows a isometric view of a external wall of a structure in which the termite resistant band is shown extending across an external wall. The termite resistant band 21 extends across a mortar course 22 that includes the termite barrier 23 and damp proof course 24. The termite barrier 23 extends above a masonry course 25 and the end provides a visible barrier that provides a visible indication of plasters that may be used by termites to bridge the termite barrier. The band may be a pre-formed strip or may be applied as settable or curable coating. The presence of the band engaged to the termite barrier prevents termites breaching the mortar 26 that provides a continuous network through the external structure of the wall.

Figure 3:
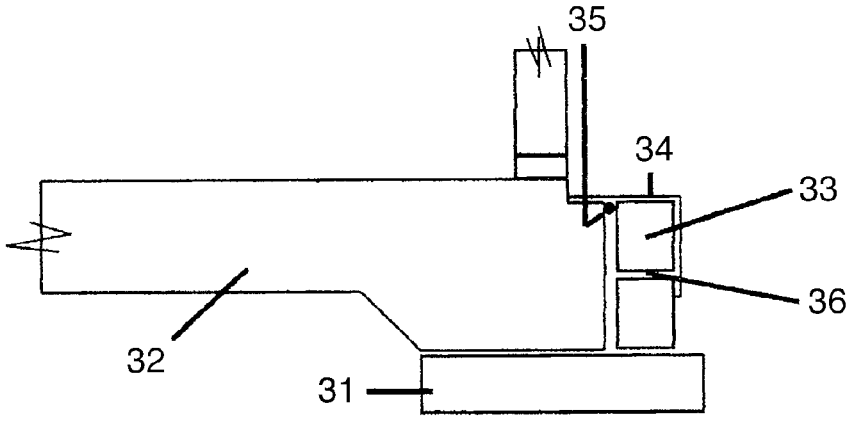
FIG. 3 is a sectional view of a building structure including a footing on which a slab is formed.

FIG. 3 shows a building structure comprising a footing 31 on which a slab 32 is formed. A masonry wall 33 is formed on the footing 31. At about the height of the top of the slab 32 in the rebate a termite resisting sealant is applied from the slab across the adjacent masonry course. A termite resistant bead 35 is disposed between the slab and the adjacent masonry course to provide a termite resisting barrier. The termite resisting sealant 34 extends from the slab across the adjacent bead 35 and the masonry course and across the outer surface of the external wall 33 to provide a visible barrier across which termites would need to construct plasters in order to bridge the termite resisting barrier. It is preferred that the termite resisting sealant be applied so as to extend over a second mortar course 36 which, in another embodiment may extend down to footing 31.

Figure 4:
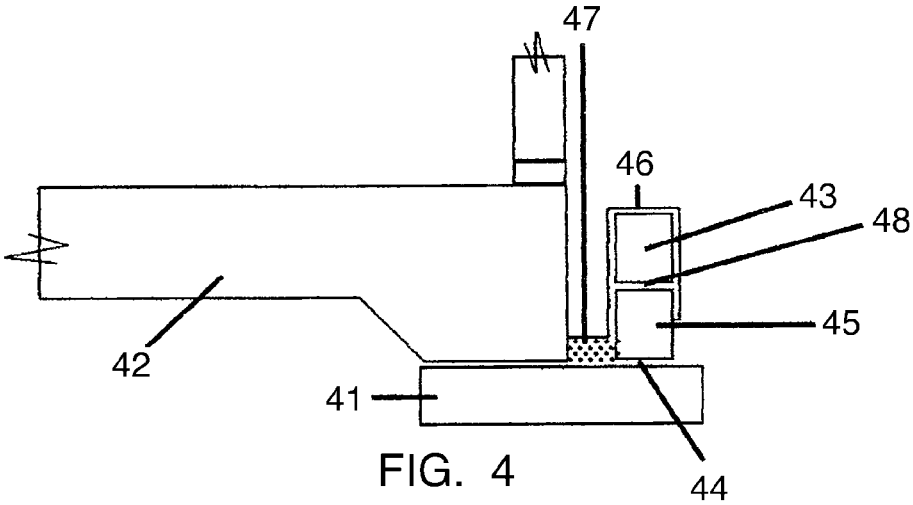
FIG. 4 is a sectional view of a building structure including a footing on which a slab is formed with a friable termite resistant particulate material included.

FIG. 4 shows a building structure having a footing 41 on which a slab 42 is formed. An external wall 43 is disposed on the footing 41 and is spaced apart from the slab 42. A mortar course 44 extends between the masonry course 45 and the footing 41. A friable termite resistant particulate material 47 is disposed between the interface of the external wall 43 and the slab 42 and extends across the gap between the slab 42 and the footing 41 and the mortar course 44 and the footing 41.

A termite resistant sealant 46 is applied and extends from the friable particulate material 47 and covers the internal face of external wall 43. The termite resistant sealant 46 also extends across a mortar course 48 and a masonry course 45 and covers the external face of the external wall 43 so as to provide a visual inspection band covering at least one mortar course 48, and in a preferred embodiment may extend down to the footing 41.

Figure 5:
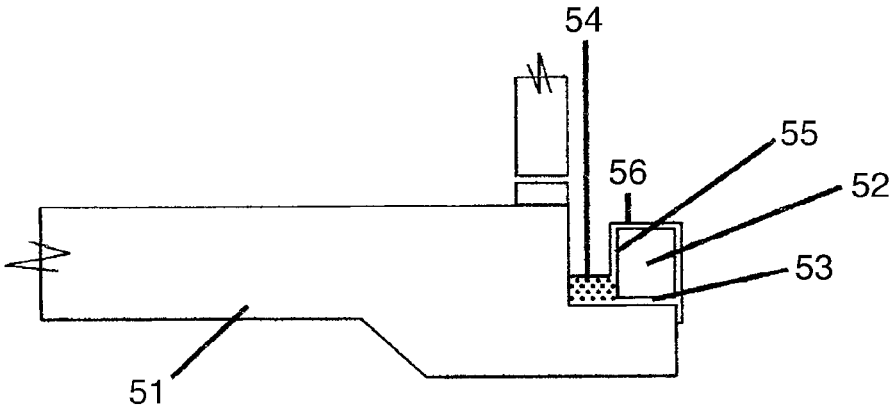
FIG. 5 is a sectional view of a building structure including a monolithic slab with a friable termite resistant particulate material included and in which the termite resistant band extends down to the slab.

FIG. 5 shows a building construction having a monolithic slab 51. An external wall 55 is disposed on the monolithic slab 51 and is spaced apart from the monolithic slab 51. A mortar course 53 extends between the masonry course 52 and the monolithic slab 51. Friable particulate material 54 is disposed within the cavity of the external wall 55 and the monolithic slab 51 and extends across the gap between the monolithic slab and the mortar course 53.

A termite resistant sealant 56 is applied and extends from the friable particulate material 54 and covers the internal face of external wall 55. The termite resistant sealant 56 also extends across a mortar course 53 and a masonry course 52 and covers the external face of the external wall 55 so as to provide a visual inspection band covering at least one mortar course 53, and in a preferred embodiment may extend down to the footing 51.

In a preferred form, the termite resistant sealant 56 is applied to the external wall face 55 (to form a termite resistant barrier as required) from where a physical termite barrier would usually protrude in the brick/block course, down to the monolithic slab 51.

Figure 6:
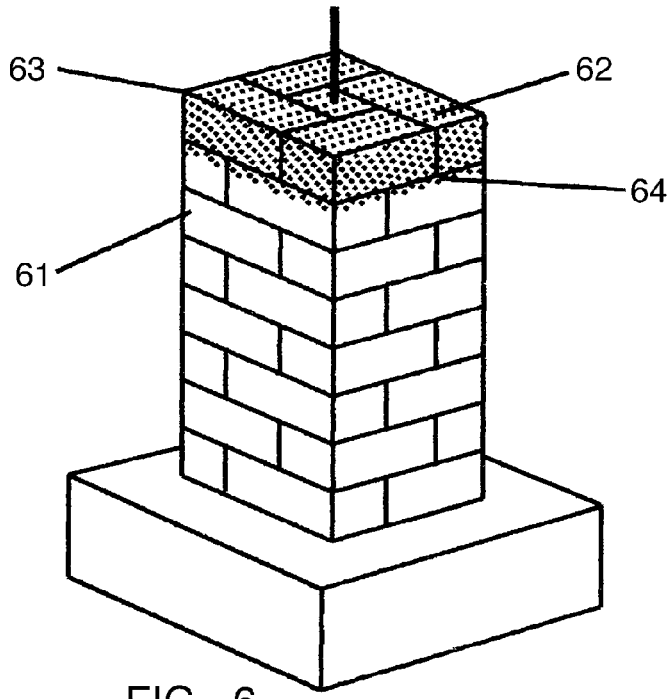
FIG. 6 shows a pier of standard brick or block construction including a termite resistant sealant across a masonry course and an external surface of the pier.

FIG. 6 shows a pier 61 of standard brick or block construction, which pier 61 includes a termite resistant sealant 62 that is applied across a masonry course 63 and across the external surface of the pier so as to provide a termite resistant barrier that crosses mortar course 64, which may extend down to the footing.

Figure 7:
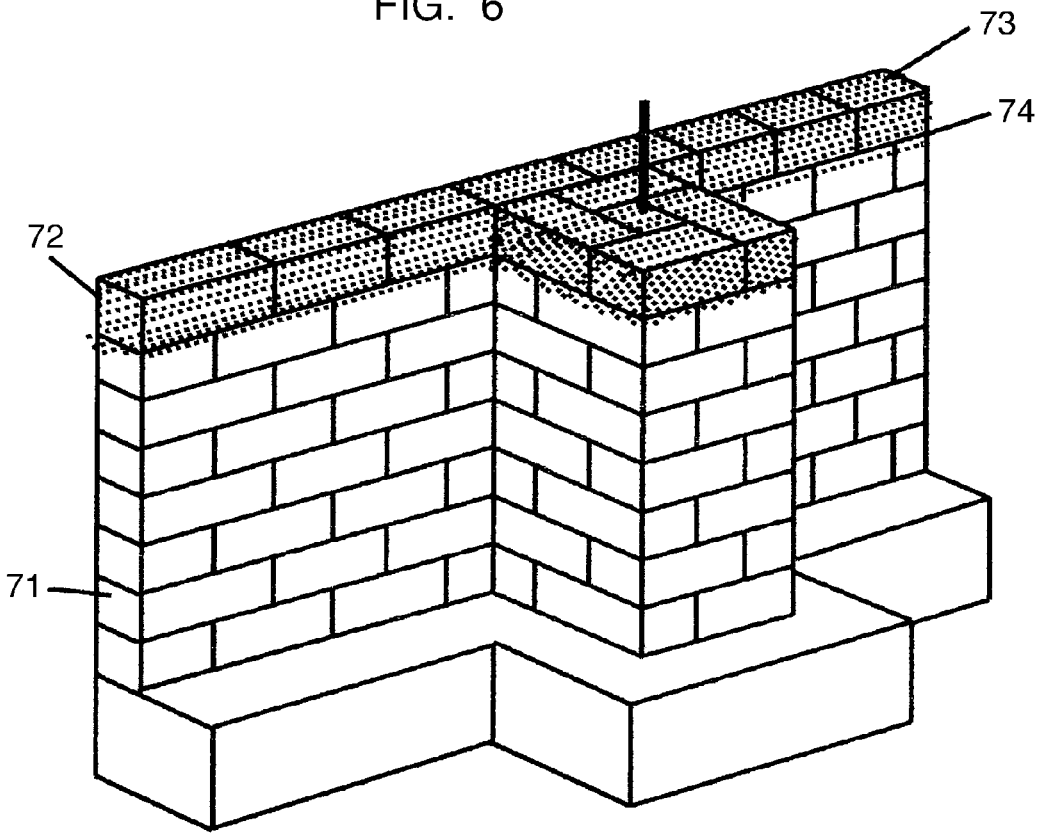
FIG. 7 shows an external wall that includes a termite resistant sealant applied across the masonry course and an external surface of the wall.

FIG. 7 shows an external wall 71 that includes a termite resistant sealant 72 that is applied across a masonry course 73 so as to extend across the external surface of the wall 71 and cover mortar course 74, which may extend down to the footing.

Figure 8:
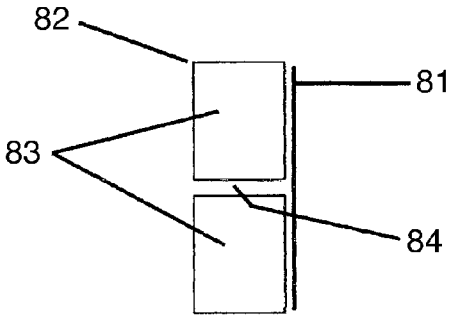
FIG. 8 is an enlarged view of a visible inspection band provided in the form of a termite resistant sealant.
Figure 8A:
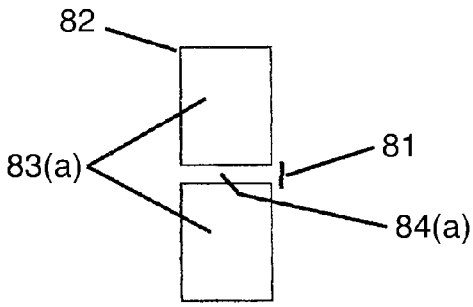
FIG. 8A is an enlarged view of the positioning of sealant according to a preferred embodiment over the mortar joints in a masonry course.

FIG. 8 shows a enlarged view of a visible inspection band provided by the present invention in the form of a termite resistant sealant. The termite resistant sealant 81 is applied across an external face of an external wall 82. The termite resistant sealant 81 is absorbed into the porous masonry 83 and also the porous mortar course and perpends 84. The absorption of the termite resistant sealant into the bricks and blocks 83 as well as the mortar 84 provides an improved termite resistant barrier which, in order to be bridged requires the termite to build substantial plasters over the external surface of the wall whereby the plasters are readily visible and can be readily identified. In one form, shown in FIG. 8*a*) the sealant may only be applied to the mortar joints 84(*a*) if masonry 83(*a*) is termite resistant.

Figure 9:
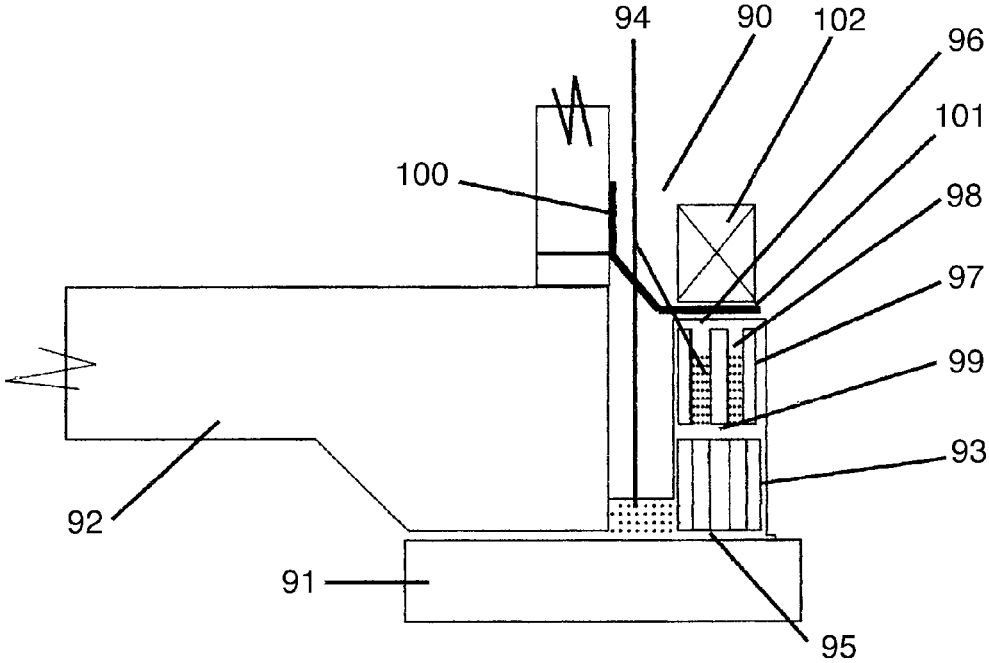
FIG. 9 shows a building structure built on a footing.

FIG. 9 shows a building structure 90 built on a footing 91. A slab 92 is formed on the footing 91. An external wall 93 is also formed on the footing 91. A friable particulate material 94 is disposed within the cavity between the slab 92 and the external wall 93. The friable particulate material 94 is charged with a termite resisting material and prevents termites from accessing the cavity from the gap between the slab 92 and the footing 91 as well as through the first mortar course 95. A termite resistant sealant 96 is applied to the internal surface of the external wall 93 and across and around a masonry course 97. The termite resistant sealant 96 may be applied across the top, and sides of the masonry course 97 or any other masonry course for that matter, provided that the termite resistant sealant extends from the friable particulate material 94 to said masonry course. The masonry course may include friable particulate material applied within any cavities therein 98 and extend across the external surface of the masonry course and other at least one mortar course 99 to provide a visible inspection band or down to the top of footing 91.

The structure may also include a damp proof course 100 located above the termite resistant sealant on which a further mortar course 101 is disposed. Masonry course including weep holes 102 may be positioned immediately above the damp proof course, which may itself be attached to the internal wall of the structure.

Figure 10:
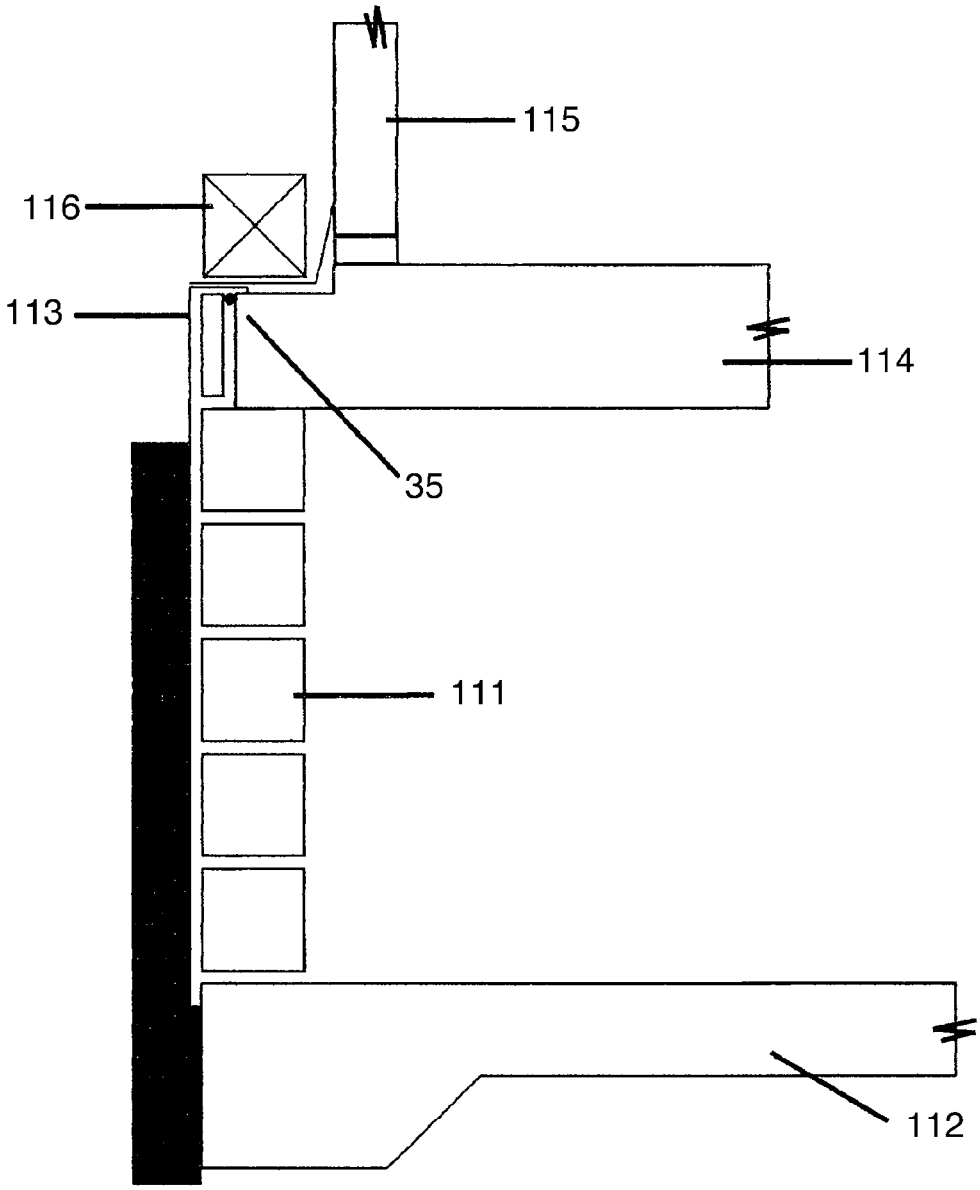
FIG. 10 shows a retaining wall mounted on a slab on ground with a suspended slab located above the slab on ground.

FIG. 10 shows a retaining wall 111 mounted on a slab 112. The external face of the retaining wall 111 includes a termite resistant sealant 113. The termite resistant sealant 113 extends over the entire external surface of the retaining wall 111 and down to the slab 112. The termite resistant sealant 113 extends up to a suspended slab 114 and engages a damp proof course that extends from an inner wall 115 mounted on the suspended slab 114. A masonry course including weep holes 116 is provided on the suspended slab 114.

The invention claimed is:

1. A method of inhibiting the migration of termites into a structure wherein the structure comprises a concrete slab, a footing and an external masonry wall having an internal face and an external face, the concrete slab and the external masonry wall being supported on the footing, the external masonry wall abutting the slab on the interior surface of the external masonry wall forming a joint, the method including applying a bead of clear termite resistant sealant to the joint between the slab and a course of the external masonry wall abutting the slab and further directly applying a continuous clear termite resistant sealant layer to the structure extending over and sealing at least a portion of the slab adjacent the external masonry wall, extending over the bead of termite resistant sealant and over the course and further extending onto the external face of the external masonry wall to provide a continuous visual inspection band which extends across the boundaries of adjacent components of said external masonry wall, the termite resistant sealant layer at least partially penetrating the concrete slab and the external masonry wall, wherein the portion of the slab and the external masonry wall to which the clear termite resistant sealant layer is applied remains visually unobstructed and uncovered.

2. A method according to claim 1 wherein the continuous visual inspection band extends down to the footing.

3. A method according to claim 1 wherein the footing is a separately formed footing.

4. A method according to claim 1 wherein the footing is integrally formed with the concrete slab in the form of a monolithic slab.

5. A method of inhibiting the migration of termites into a structure wherein the structure comprises a termite resistant base support supporting an external masonry wall having an interior face and an exterior face formed from a plurality of components, the method including directly applying a clear termite resistant sealant forming a continuous layer over a portion of the termite resistant base support and extending over an exterior face of external masonry wall and extending over an exterior face of at least one exposed course of mortar between adjacent components of the plurality of components, the clear termite resistant sealant at least partially penetrating the termite resistant base support, the external masonry wall and the at least one exposed course of mortar, wherein the portion of the termite resistant base support, the external masonry wall, and the at least one exposed course of mortar to which the clear termite resistant sealant is applied remains visually unobstructed and uncovered, the continuous clear layer extends across boundaries of the adjacent components of said masonry wall to form a continuous visual inspection zone extending across at least a portion of the termite resistant base support and across the boundaries of the adjacent components of the termite resistant base support.

6. A method according to claim 5 wherein the termite resistant sealant includes any one or more of polymer binders, mineral extenders, biocides, fungicides, mold inhibitors, acrylic resins, acrylic emulsions, powered acrylic polymers, and moisture control, reinforcement such as fibrous matting, waterproofing or water-repellent agents and plasticizing agents.

7. A method according to claim 5 wherein the termite resistant sealant includes at least one termite resisting component.

8. A method according to claim 5 wherein the termite resistant sealant is applied to the external masonry face or applied to a render applied to the external masonry face to form a termite resistant barrier and inspection zone.

9. A method according to claim 5 wherein the termite resistant sealant is further incorporated into the mortar blend such when set the mortar integrally includes the termite resistant sealant.

10. A method according to claim 5 wherein the termite resistant sealant extends into a cavity between the external masonry wall and the termite resistant base support and engages with a physical termite barrier disposed within the cavity.

11. A method according to claim 5 wherein the termite resistant base support includes a footing and a separately formed slab.

12. A method according to claim 5 wherein the termite resistant base support includes a footing integrally formed with a concrete slab in the form of a monolithic slab.

13. A method according to claim 5 wherein the termite resistant sealant is a settable or curable composition applied to an exterior portion of the termite resistant base support and at least a part of the external masonry wall.

14. A method according to claim 5 wherein the termite resistant sealant is a fluid applied to an exterior portion of the termite resistant base support and at least a part of the external masonry wall which impregnates the termite resistant base support and at least a part of the external masonry wall.

15. A method according to claim 5 wherein the termite resistant sealant is applied to at least a part of the external masonry wall disposed above ground level.

16. A method according to claim 5 wherein the termite resistant sealant extends into the external masonry wall and engages with an existing physical termite barrier disposed within the external masonry.

* * * * *